US005627634A

United States Patent [19]

Koh

[11] Patent Number: 5,627,634

[45] Date of Patent: May 6, 1997

[54] IMAGE FIXING APPARATUS HAVING A HEATER ENERGIZED AND CONTROLLED BY ELECTRIC ENERGY

[75] Inventor: Shokyo Koh, Yokohama, Japan

[73] Assignee: Canon Kabushiki Kaisha, Tokyo, Japan

[21] Appl. No.: 154,128

[22] Filed: Nov. 18, 1993

Related U.S. Application Data

[63] Continuation of Ser. No. 829,582, Feb. 3, 1992, abandoned, which is a continuation of Ser. No. 450,560, Dec. 14, 1989, abandoned.

[30] Foreign Application Priority Data

Dec. 15, 1988 [JP] Japan ..... 63-317245
Dec. 15, 1988 [JP] Japan ..... 63-317247

[51] Int. Cl.[6] ..... G03G 15/20

[52] U.S. Cl. ..... 399/69; 219/216

[58] Field of Search ..... 355/282, 285, 355/290; 219/482, 216; 346/25

[56] References Cited

U.S. PATENT DOCUMENTS

| | | | |
|---|---|---|---|
| 3,692,408 | 9/1972 | Nakamura | 355/282 X |
| 3,937,921 | 2/1976 | Furuichi et al. | 219/216 X |
| 4,078,168 | 3/1978 | Kelly | 219/497 |
| 4,113,375 | 9/1978 | Murata et al. | 355/285 |
| 4,493,984 | 1/1985 | Yamauchi | 219/216 X |
| 4,905,051 | 2/1990 | Satoh et al. | 355/290 |
| 4,906,820 | 3/1990 | Haarmann et al. | 219/497 |
| 4,954,845 | 9/1990 | Yano et al. | 355/290 |
| 4,998,121 | 3/1991 | Koh et al. | 346/160 |

FOREIGN PATENT DOCUMENTS

| | | | |
|---|---|---|---|
| 0295901 | 12/1988 | European Pat. Off. | 355/285 |
| 362791 | 4/1990 | European Pat. Off. . | |
| 361562 | 4/1990 | European Pat. Off. . | |
| 0211164 | 12/1982 | Japan | 355/285 |
| 0044782 | 2/1987 | Japan | 355/282 |
| 0101850 | 5/1988 | Japan | 355/285 |
| 0313182 | 12/1988 | Japan . | |

*Primary Examiner*—Nestor R. Ramirez
*Attorney, Agent, or Firm*—Fitzpatrick, Cella, Harper & Scinto

[57] ABSTRACT

An image fixing apparatus includes a heater having heat generating resistors producing heat by being supplied with electrical energy; a film movable together with a recording material, wherein a toner image on the recording material is heated by heat generated by the heat generating resistors through the film; an energizing device for energizing the heat generating resistor with an AC voltage; a temperature detecting element for detecting a temperature of the heater; and a control device, responsive to an output of the temperature detecting element, to control a phase of the AC voltage.

7 Claims, 11 Drawing Sheets

PHASE CONTROL

INPUT
AC VOLT
FIG. 9B D
Vc
CH
CL
Ov
FIG. 9C E
Vc
O
FIG. 9D VH
FIG. 9E E'
Vc
O
FIG. 9F VH'

IMAGE FIXING APPARATUS HAVING A HEATER ENERGIZED AND CONTROLLED BY ELECTRIC ENERGY

This application is a continuation of U.S. patent application Ser. No. 07/829,582 filed Feb. 3, 1992, now abandoned, which in turn is a continuation of U.S. patent application Ser. No. 07/450,560, filed Dec. 14, 1989, also abandoned.

FIELD OF THE INVENTION AND RELATED ART

The present invention relates to an image fixing apparatus for heating and fixing a toner image formed on a recording material, an more particularly to the image fixing apparatus wherein the toner image is heated through a film.

In a widely used image fixing apparatus for fixing a toner image on the recording material, the recording material carrying the fixed toner image is passed through a nip formed between a heating roller maintained at a predetermined temperature and a pressing or back-up roller having an elastic layer and press-contacted to the heating roller (heating roller type).

In order to prevent high temperature off-set and low temperature off-set, the surface of the heating roller has to be maintained at a predetermined temperature very precisely. Therefore, the heating roller is required to have a large thermal capacity, with the result that the warming period until the surface of the heating roller reaches a predetermined temperature, is long.

U.S. patent application Ser. No. 206,767 which has been assigned to the assignee of this application proposes an image fixing apparatus using a low thermal capacity heater and a thin film, by which the warming period is significantly reduced or eliminated. In this fixing apparatus, a heat generating resistance layer is pulsewisely energized, by which the heat generating layer is instantaneously heated. Therefore, it requires a pulse converting circuit for converting an AC voltage to a pulse voltage. In addition, if the control system is such that similarly to the case of the heating roller, the temperature of the heater is maintained constant by deenergizing the heater when the surface temperature is higher than a predetermined level and energizing the heater when it is lower than the predetermined, the over-shooting of the desired temperature is large because the heat generating resistance layer has a very low thermal capacity with the result of large ripple of the temperature control.

SUMMARY OF THE INVENTION

Accordingly, it is a principal object of the present invention to provide an image fixing apparatus wherein a phase of an AC voltage can be controlled.

It is another object of the present invention to provide an image fixing apparatus wherein a number of waves of an AC voltage can be controlled.

It is a further object of the present invention to provide an image fixing apparatus having a small ripple during the temperature control.

While the invention has been described with reference to the structures disclosed herein, it is not confined to the details set forth and this application is intended to cover such modifications or changes as may come within the purposes of the improvements or the scope of the following claims.

DESCRIPTION OF THE PREFERRED EMBODIMENTS

Referring to the accompanying drawings, the preferred embodiments of the present invention will be described.

Figure 1:
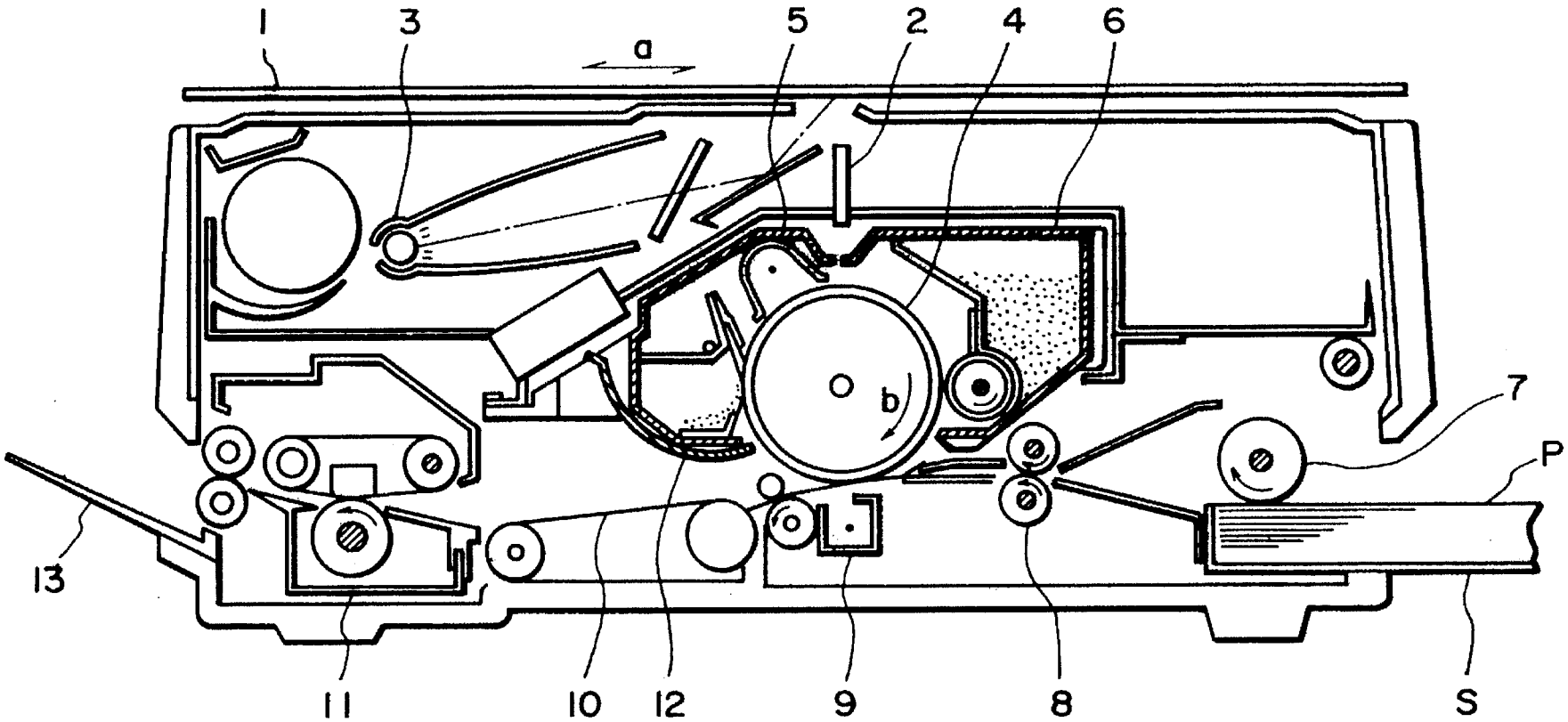
FIG. 1 is a sectional view of a copying machine having an image fixing apparatus according to an embodiment of the present invention.

FIG. 1 shows a sectional view of an image forming apparatus using an image fixing device according to an embodiment of the present invention. The image forming apparatus comprises an original supporting platen made of transparent material such as glass, which is reciprocable in the directions indicated by an arrow a to scan an original. Right below the original supporting platen 1, there is disposed a short focus small diameter imaging element array 2. An image G of an original placed on the original supporting platen 1 is illuminated by an illumination lamp 3, and the light image provided by the light reflected by the original G is imaged through a slit by the array 2 on a photosensitive drum 4. The photosensitive drum 4 is rotatable in the direction indicated by an arrow b. The apparatus further comprises a charger 5 for uniformly charging the photosensitive drum 4 which is coated with a zinc oxide photosensitive layer or an organic semiconductor photosensitive layer. The photosensitive drum 4 uniformly charged by the charger 5 is exposed to the light image through the array 2, so that an electrostatic latent image is formed thereon. The electrostatic latent image is developed into a visualized image by a developing device 6 with toner particles containing resin material which is softened or fused by heat. On the other hand, a transfer material P which is a sheet-like recording medium accommodated in the cassette S is fed to the photosensitive drum 4 by a pick-up roller 8 and a pair of conveying rollers 8 press-contacted to each other, in timed relation with the image on the photosensitive drum 4. The toner image on the photosensitive drum 4 is transferred onto the transfer material P by a transfer discharger 9. Thereafter, the transfer material P separated from the photosensitive drum 3 by known separating means is conveyed along a conveyance guide 10 into an image fixing apparatus 11, where it is subjected to a heating and fixing operation. Finally, it is discharged to a tray 13. After the toner image is transferred, the toner remaining on the photosensitive drum 4 is removed by a cleaner 12.

Figure 2A:
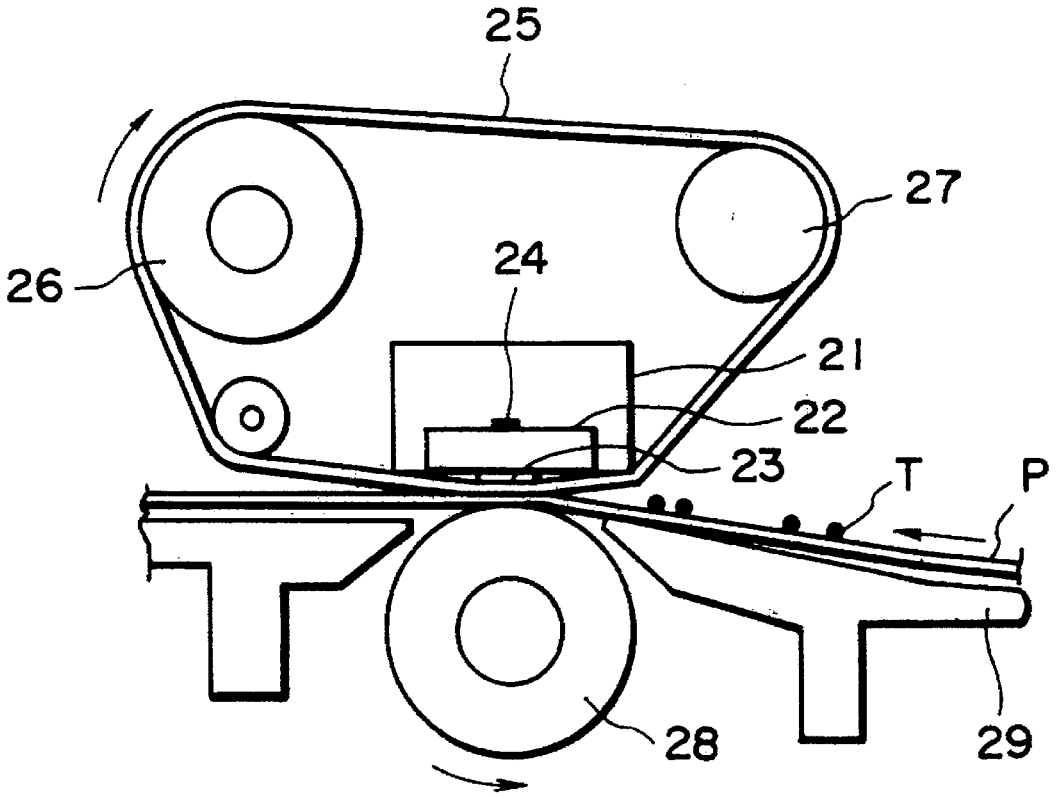
FIG. 2A is an enlarged sectional view of an image fixing apparatus used with the copying machine of FIG. 1.

FIG. 2 is an enlarged sectional view of the image fixing apparatus 11 according to this embodiment. The fixing apparatus 11 comprises a fixed linear heat generating element 21 having a low thermal capacity. It is, for example, an alumina base plate 22 having a thickness of 1.0 mm, a width of 10 mm and a length of 240 mm, coated with resistance material 23 having a width of 1.0 mm. It is electrically connected at an opposite end thereof.

The energization is effected with AC 100 V and is controlled such that the temperature detected by the temperature detecting element 24 is constant.

The fixing film 25 is in sliding contact with the heater 21 maintained at a predetermined temperature, and moves in the direction indicated by an arrow. It is, for example, an endless film made of a heat-resistive film, having a thickness of 20 microns, of polyimide, polyetherimide, PES or the like, which is coated with a parting layer, having a thickness of 10 microns, of fluorine resin such as PTFE or PFA to which conductive material is added at least at its image contacting side. Generally, the total thickness thereof is less than 100 microns, preferably 40 microns. The film drive is effected by a driving roller 26, a follower roller 27 and the tension force therebetween in the direction without crease.

A pressing roller 28 has a rubber elastic layer made of silicone rubber having a good parting property. The pressing roller 28 is pressed to the heater through the film with a total pressure of 4–7 kg.

The unfixed toner T on the sheet P is introduced into the fixing apparatus through an inlet guide 29, and is fixed by the heat.

Figure 2B:
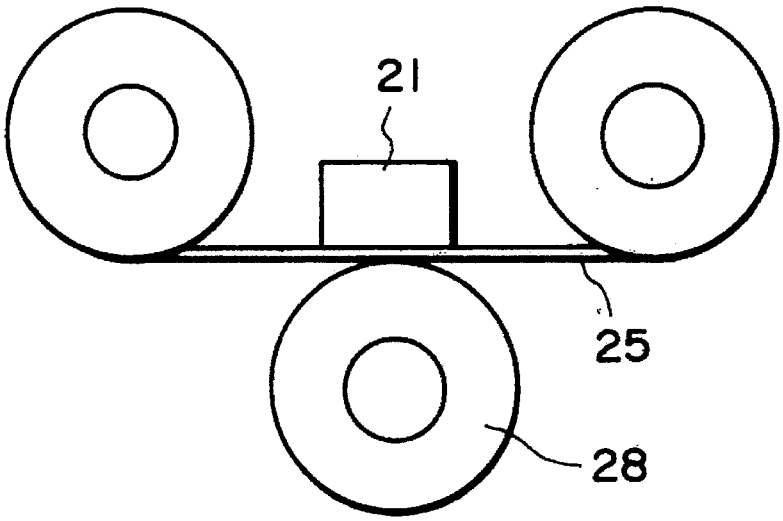
FIG. 2B is an enlarged sectional view of an image fixing apparatus according to another embodiment of the present invention.

In the foregoing descriptions, the fixing film is in the form of an endless belt, but may be a non-endless belt as shown in FIG. 2B.

The present invention is applicable to any fixing apparatus wherein the image is formed with toner in an image forming apparatus such as copying machine, a printer or a facsimile machine.

Figure 3:
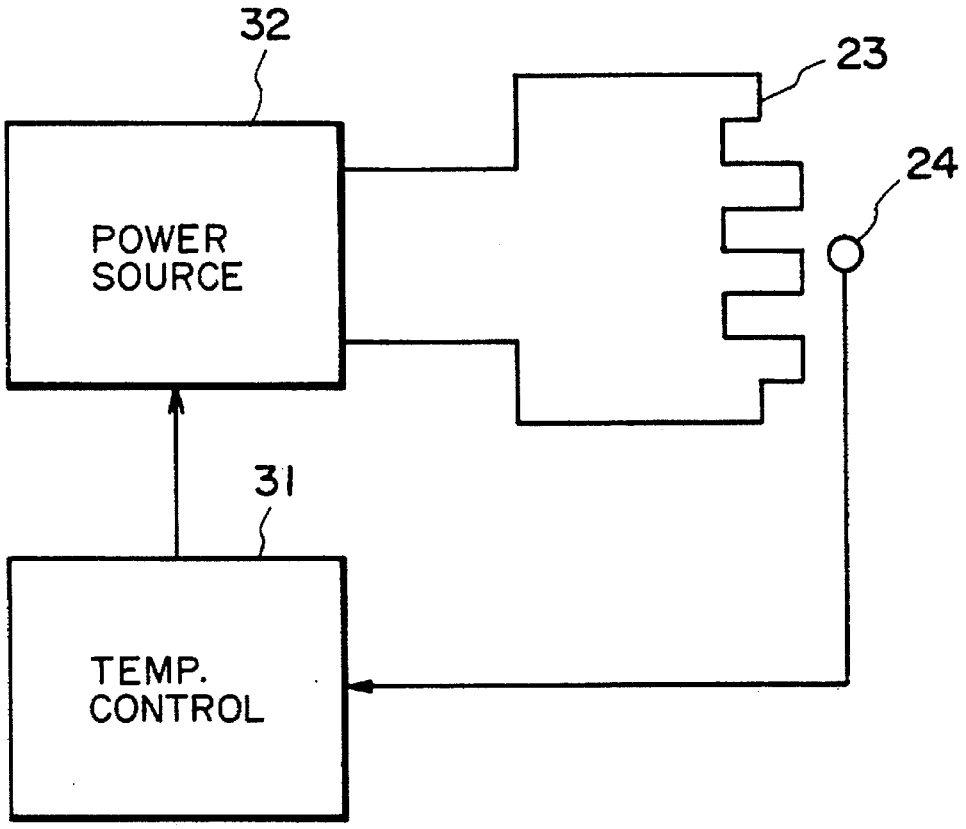
FIG. 3 is a block diagram of a control system usable with the image fixing apparatus according to the embodiment of the present invention.

FIG. 3 is a block diagram illustrating the temperature control system according to this embodiment. The heat generating layer 23 made of resistance material is energized from electric power source 32 to generate heat. The temperature of the heat generating layer 23 is measured by a temperature detecting element 24 in the form of a thermistor disposed close to the heat generating layer 23. In response to the detected temperature, the temperature control circuit 31 controls the power source 32 to control the energy applied to the heat generating layer 23, so that the temperature of the heat generating layer 23 is maintained to be constant.

There is no air layer from the heat generating layer to the toner image, and the thermal capacity thereof is low, and therefore, the ripple in the control is very large if the temperature is on-off controlled in response to the output of the temperature detecting sensor 24. The control system for maintaining the constant temperature of the heat generating layer 24 will be described in detail. In this embodiment, the phase of the energizing AC voltage is controlled.

Figure 4:
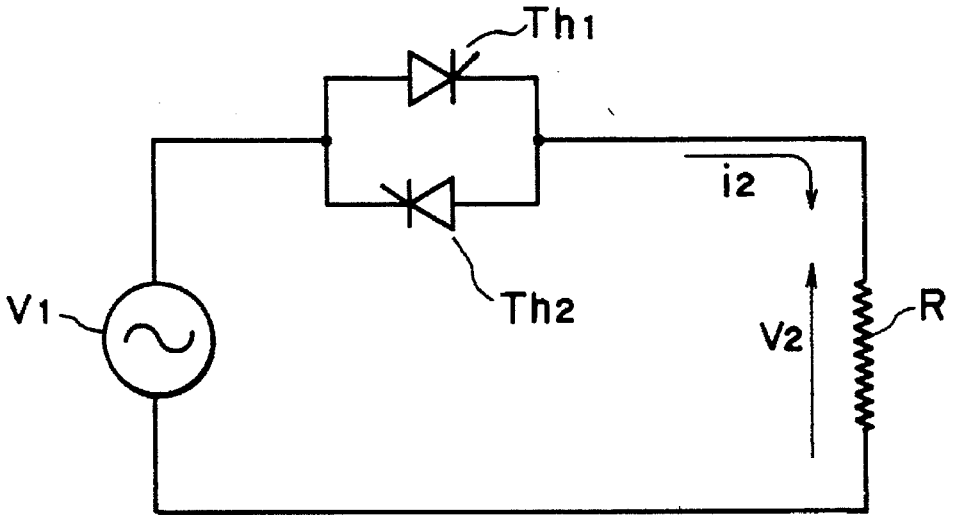
FIG. 4 is a circuit diagram illustrating the fundamental structure of a single phase AC voltage control circuit.

Referring to FIG. 4, a fundamental structure of a single phase AC voltage control circuit is shown. It includes thyristors Th1 and Th2 which are connected in a reversed manner. In place of the thyristors Th1 and Th2, a TRIAC (triode AC switch) is usable. A control angle $\alpha$ of the thyristors Th1 and Th2 is controlled to control the output AC voltage applied to a load R.

Figure 5:
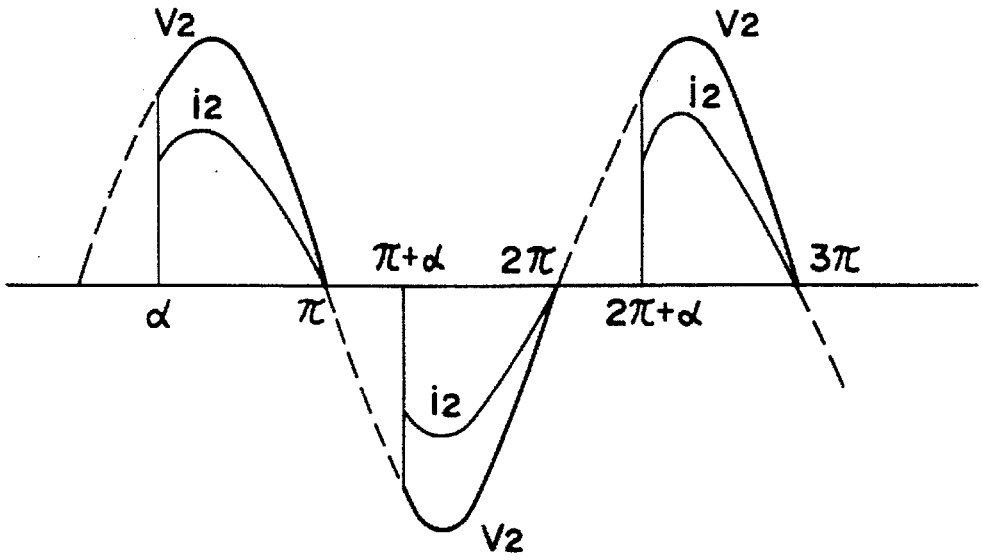
FIG. 5 shows waveforms of current and voltage in the circuit of FIG. 4.

FIG. 5 shows a waveform of the current $i_2$ and $v_2$ when the load is a pure resistance. As shown in FIG. 5, when the thyristor is controlled with the phase angle $\alpha$ controlled, the load R is supplied with a voltage ranging from $\alpha$–$\pi$. By controlling the phase angle $\alpha$ from 0–$\pi$, the effective voltage applied to the load R is controlled. In this specification, "phase control" means the control arising from changing the control phase angle to control with energizations shorter than one half period. If the load is inductive, the load is supplied with the voltage up to the extinction angle $\beta$ of the thyristor. In this case, the control range is from $\beta$ to $\pi$.

Figure 6:
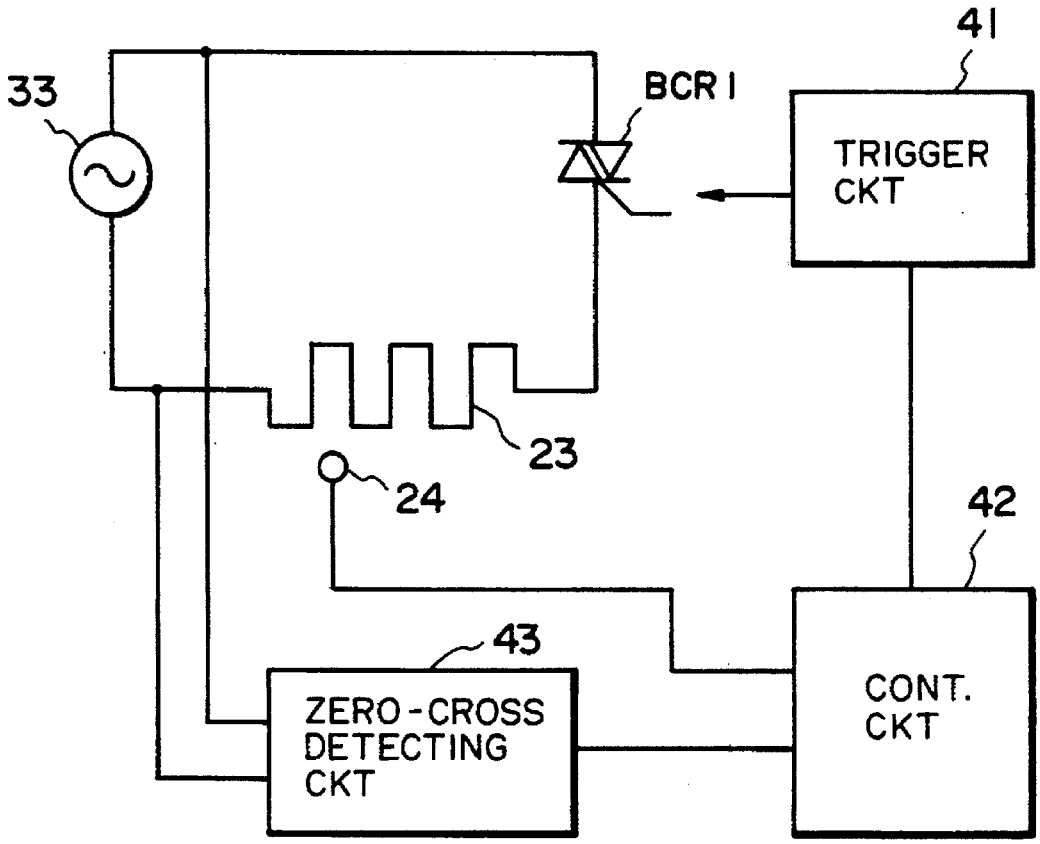
FIG. 6 is a block diagram illustrating the circuit structure for performing a phase control.

Referring to FIG. 6 which is a block diagram, the temperature control operation for the heat generating layer using the phase control will be described. In FIG. 6, designated by a reference BCR1 is a TRIAC which is supplied with a gate voltage through a triggering circuit 41. To the heater 23, the phase controlled voltage shown in FIG. 5 is applied in accordance with the triggering phase of the triggering circuit 41. Reference numeral 43 designates a zero-cross detection circuit for the commercially available AC voltage source. The control circuit 42 produces a control signal P to the triggering circuit 41 in synchronism with the zero-cross timing detected by the zero-cross detection circuit 43. When the triggering circuit 41 receives the control signal, the gate voltage is applied to the TRIAC BCR1, in response to which the TRIAC BCR1 is turned on. The control circuit 42 changes the control signal in accordance with an output of the temperature detecting element 24 in the form of a thermistor or the like, so that the electric power to the heat generating layer 23 is changed to control the heat generating layer temperature at a constant level.

Figure 7A:
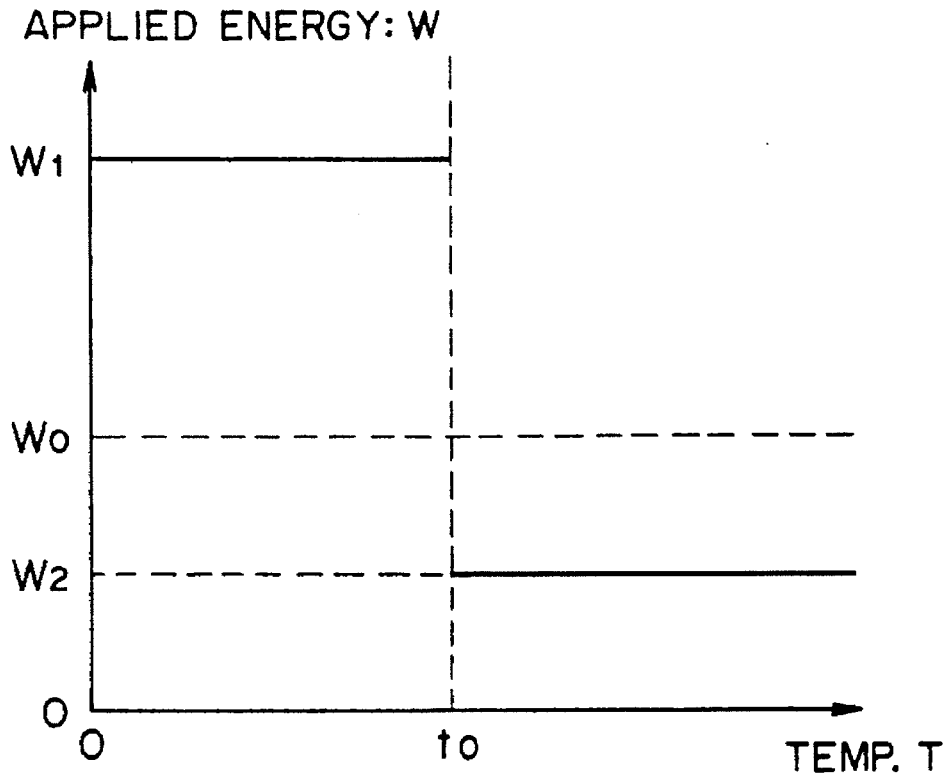
FIG. 7A shows a relationship between a temperature of the heat generating layer and the applied energy.

FIG. 7 shows a relationship among the heater temperature, the electric power applied to the heater and the waveform of the voltage applied to the heater. In FIG. 7A, to is a temperature of the heat generating layer controlled, and Wo is a quantity of heat radiated from the heat generating layer. As shown in this figure, the energy W applied to the heater is changed between energy W1 which is larger than the energy Wo and energy W2 which is smaller than the energy Wo depending on whether the temperature is higher or lower than to. By this, the temperature of the heater is maintained at to constantly.

Figure 7B:
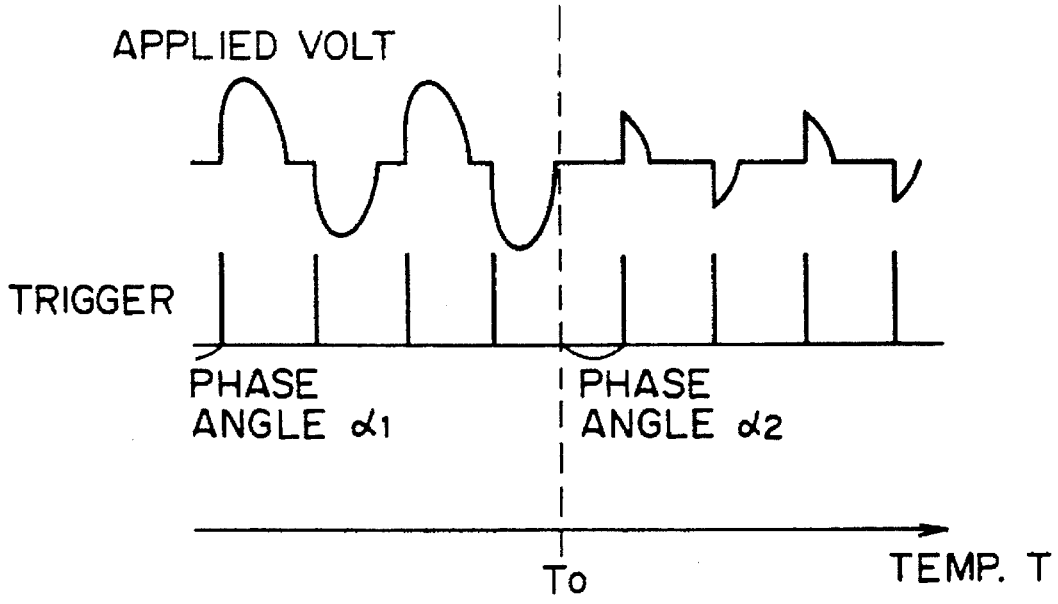
FIG. 7B shows a relation between the temperature of the heat generating layer and the waveform applied.

FIG. 7B shows the relation between the waveform of the voltage applied to the heater and the gate triggering timing of the TRIAC. As will be understood from this figure, the control trigger signal of the TRIAC is changed in accordance with the temperature of the heat generating layer. The phases $\alpha 1$ and $\alpha 2$ satisfy $0<\alpha 1<\alpha 2<\pi$.

Figure 8:
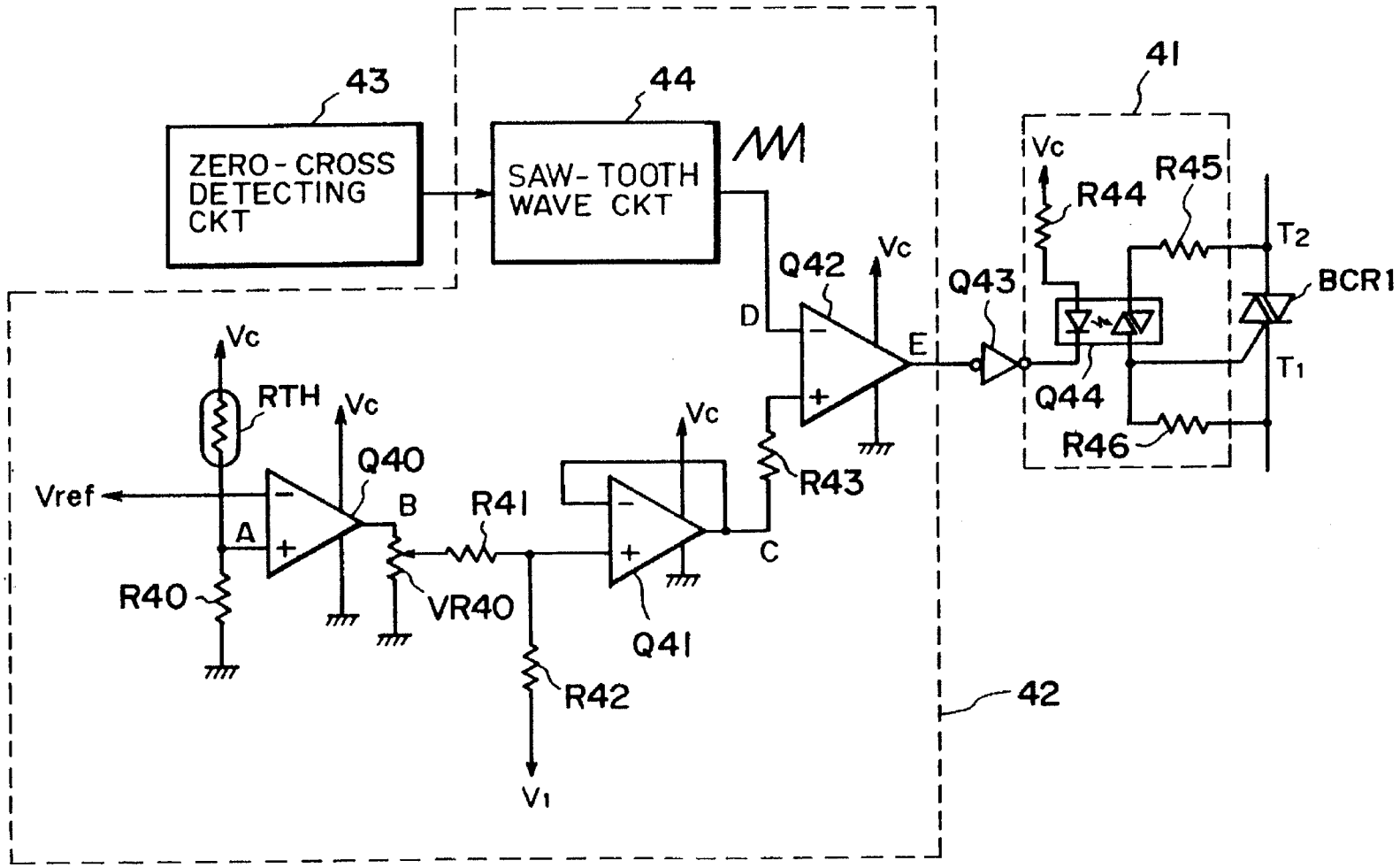
FIG. 8 is a circuit diagram showing the details of the FIG. 6 structure.

Referring to FIG. 8, the structures of the control circuit 42 and the triggering circuit 41 will be described. In this figure, references R40–R46 are resistors; $R_{TH}$ is a thermistor;

Q40–Q42 are operational amplifiers; Q43 is a driver for driving a phototriac Q44; and Vc is a power source voltage of the operational amplifier. When the current flows through the light emitting side of the phototriac Q44 in the triggering circuit, the phototriac Q44 is turned on. At this time, the trigger current flows to the gate contact of the TRIAC BCR1 through the resister R45, by which the TRIAC BCR1 is turned on.

In the control circuit 42, a saw tooth wave generating circuit 44 produces a saw tooth wave on the basis of the zero-cross timing of the AC source detected by the zero-cross detecting circuit 43.

Figure 9A:
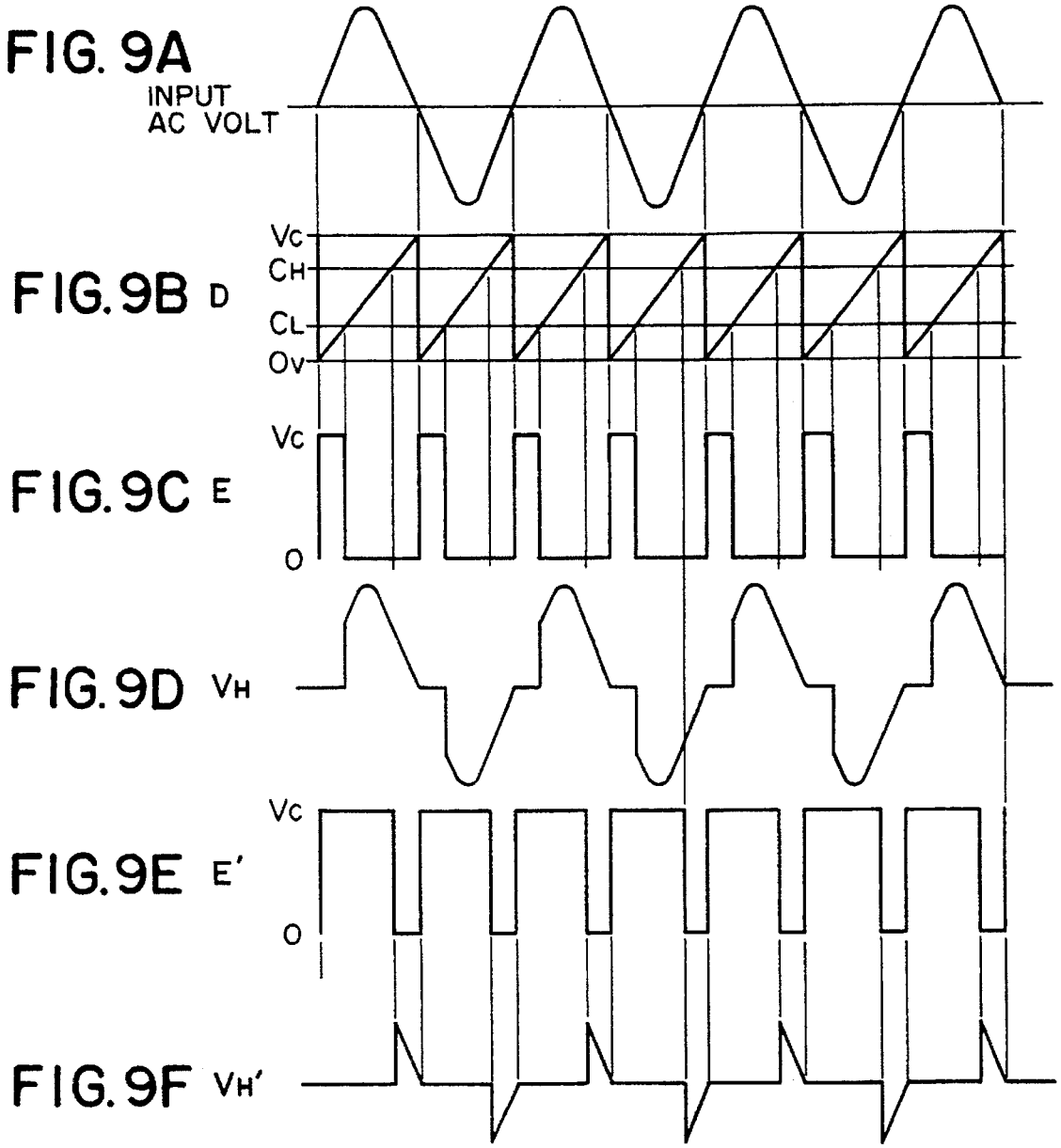
FIG. 9 shows a voltage waveform at various points in the circuit of FIG. 8.

FIG. 9 shows a waveform D which represents the relationship between the AC voltage and the phase of the saw tooth wave. The operational amplifiers Q40 and Q42 constitute a comparator, and the operational amplifier Q41 constitutes an adder. When the heater temperature is low, the voltage at point A (divided voltage by the thermistor $R_{TH}$ and the resistance 40) is small. With the increase of the temperature of the heat generating layer, the voltage of the point A becomes larger. If a reference voltage Vref is set to be equal to the A point voltage when the heater temperature is to, the voltage at a point B is 0 V when the heater temperature satisfies T≦to, and is Vc when T>to.

The comparator Q42 compares a sum of the voltage V1 and the voltage at the point B (the voltage at a point C) and the saw tooth wave (voltage at a point D), when the voltage at the point D is larger than the voltage at the point C, the TRIAC BCR1 is actuated. The voltage V1 is applied so that when the voltage at the point B is 0 V, the voltage at the point C is not 0 V (TRIAC BCR1 is prevented from being always in on-state). The circuit is such that by controlling the voltage V1 and the variable resistance VR40, the phase angle controlling the TRIAC BCR1 can be adjusted.

FIGS. 9A–9F shows the relation between the voltages at the points D and E and the energization voltage waveform VH to the heat generating layer in the control circuit 42. A voltage C1 appears at the point C when the temperature T of the heat generating layer is lower than to, and CH is a voltage when it is higher than to. The saw tooth wave when the voltage at the point C is CL and the voltage CL are compared, and the voltage waveform indicated by reference E is produced. By this, the temperature of the heat generating layer is increased. When T>to, the voltage at the point C becomes CH, and the voltage at the point of time E and the applied voltage to the heat generating layer are as shown by E' and VH'.

By the control circuit described above, the applied electric power to the heat generating layer is changed in accordance with the temperature of the heat generating layer to maintain a constant temperature of the heat generating layer.

As described, according to this embodiment, the electric power applied to the heat generating layer is changed in multi-stages, by which the ripple during the temperature control is reduced despite the heat generating layer having a low thermal capacity.

Figure 10:
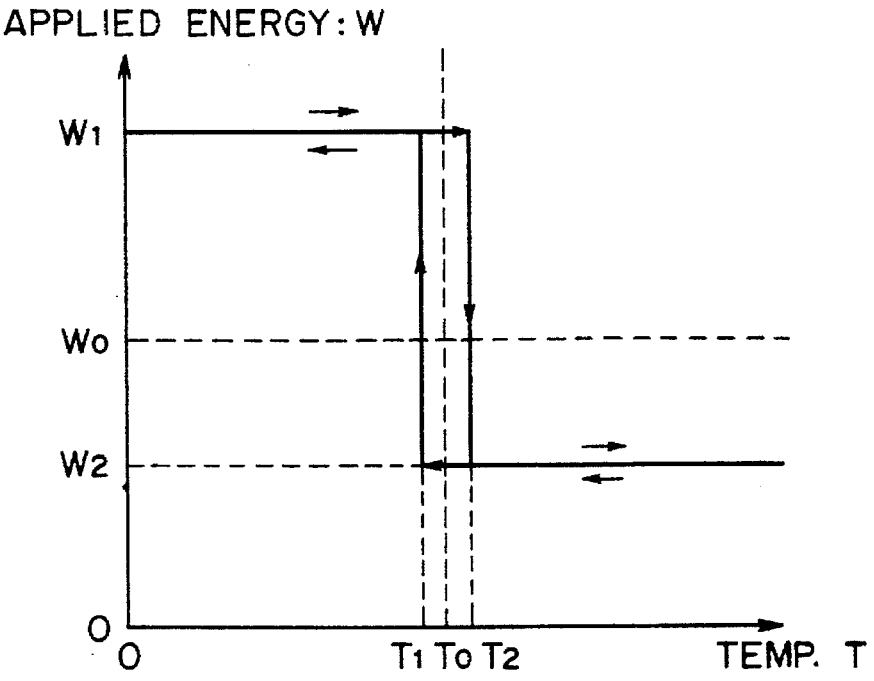
FIGS. 10, 11 and 12 show the relationships between the temperature of the heat generating layer and applied energy according to further embodiments.

As shown in FIG. 10, it is preferable that the hysteresis characteristics are provided to the applied energy W to the heat generating layer with respect to the heat generating layer temperature T. More particularly, the temperature at which the applied energy is changed is different when the temperature of the heat generating layer is increasing than when it is decreasing.

Figure 11:
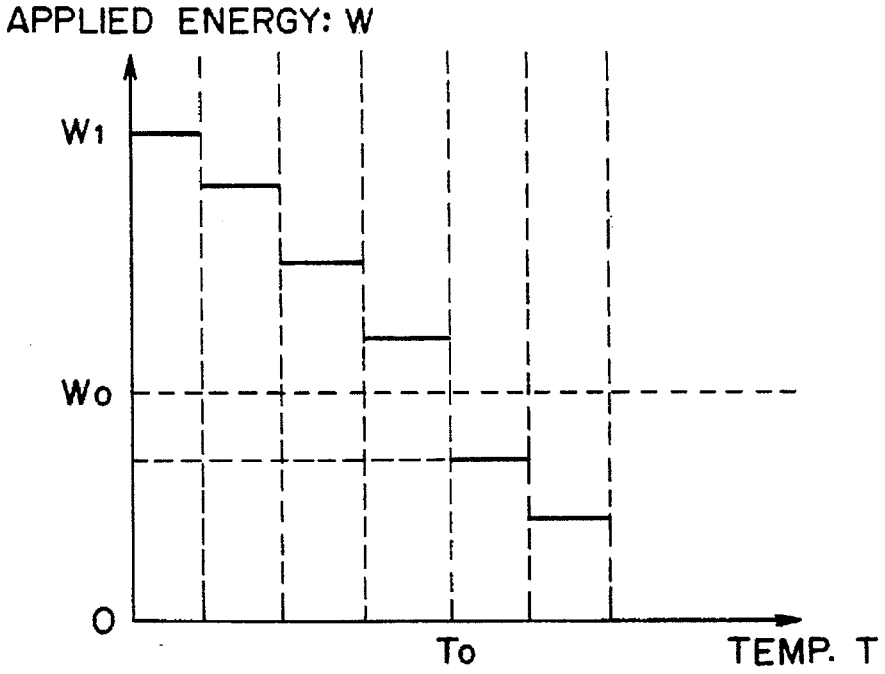

In the foregoing embodiment, the applied energy is controlled in two-stages, but the number of stages may be increased, as shown in FIG. 11.

Figure 12:
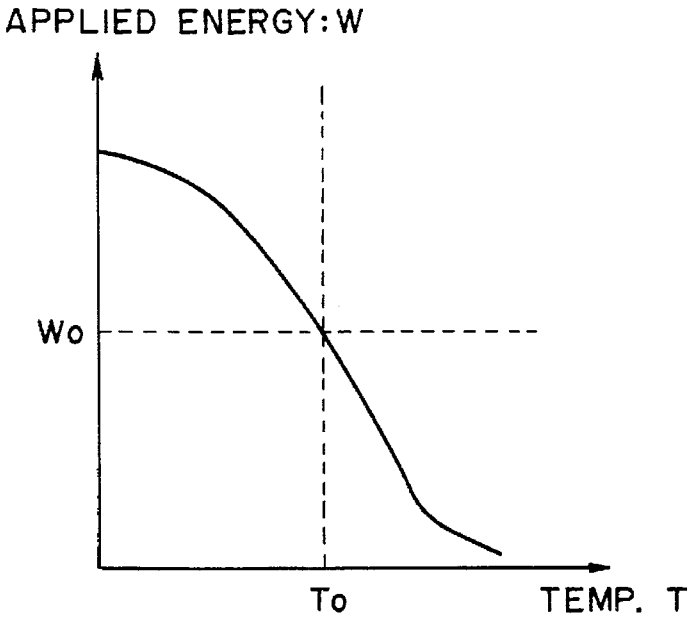
Figure 13:
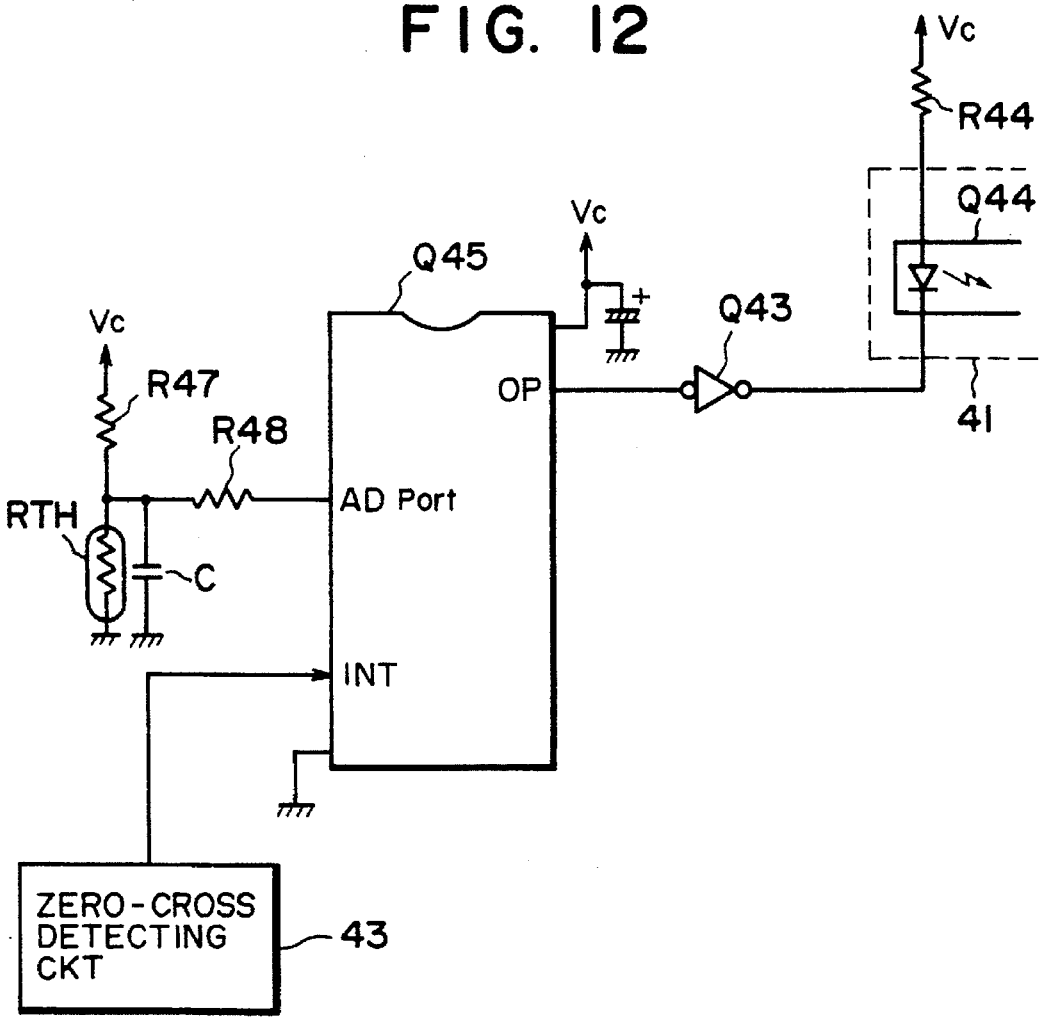
FIG. 13 shows details of a control circuit using a microcomputer.

Further, as shown in FIG. 12, the applied energy may be continuously changed. In addition, the control circuit may include a microprocessor. In this case, various relations between the heater temperature and the applied energy can be provided with a simple circuit structure. FIG. 13 shows a control circuit in the embodiment of this type. A microcomputer Q45 contains therein an A/D converter, and an analog input port AD receives a voltage divided by the thermistor $R_{TH}$ and the resistor R10. A zero-cross signal from the zero-cross detecting circuit 43 is supplied to the microcomputer Q45. The microcomputer Q45 converts the voltage received by the analog input port AD to a temperature data, and from the temperature data, a timer period is determined in accordance with on-period angle. When the signal is received from the zero-cross detecting circuit 43, the timer is started, and the phototriac Q44 is turned on through the driver Q43 after the timer period corresponding to the on-period angle.

Figure 14A:
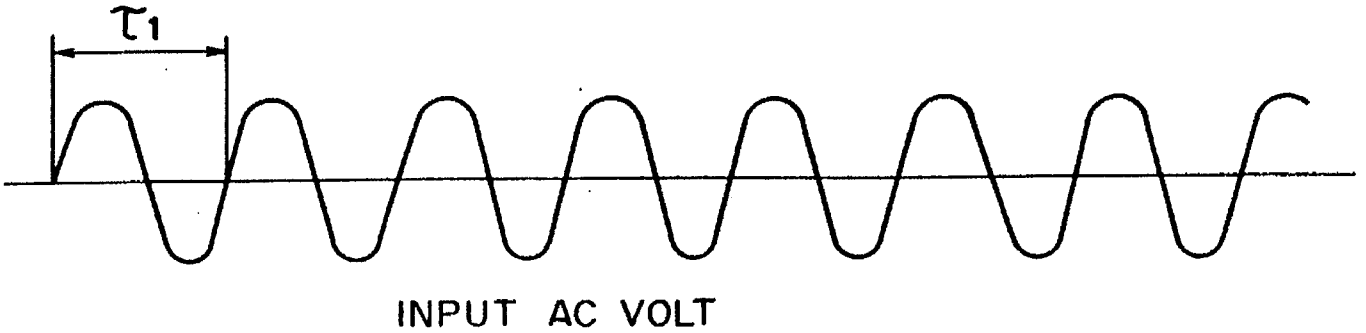
FIG. 14A shows a waveform of an input voltage.
Figure 14B:
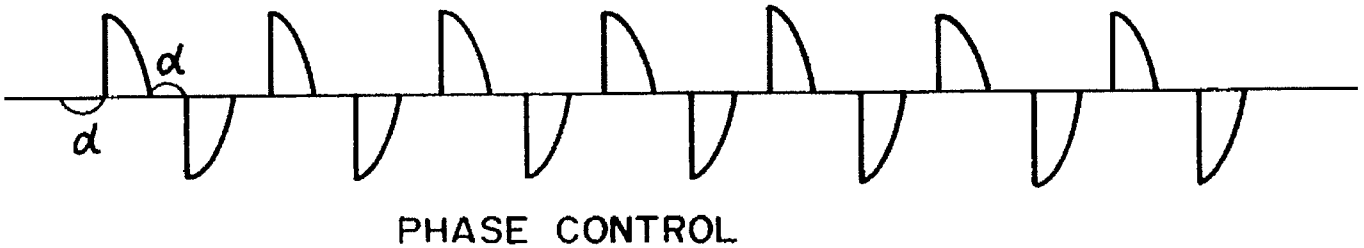
FIG. 14B shows a waveform of a voltage during a phase control operation.
Figure 14C:
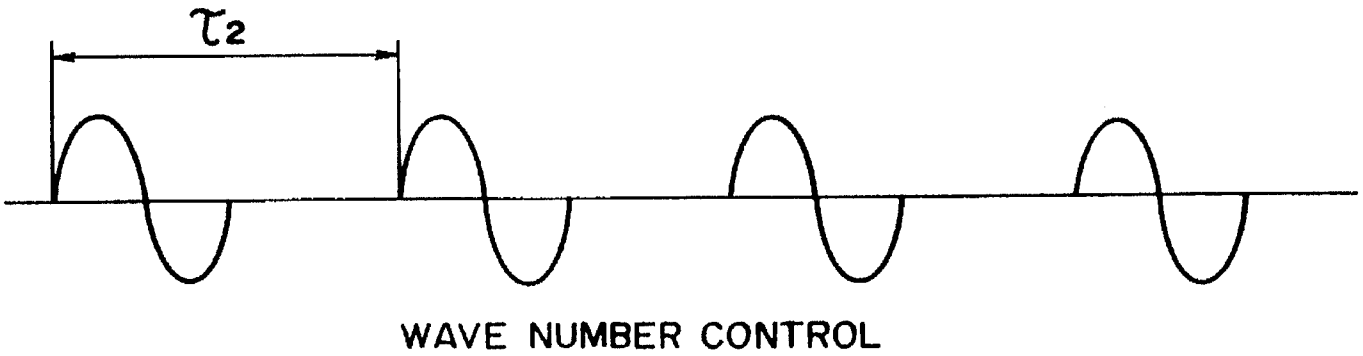
FIG. 14C shows a voltage waveform for illustrating a wave number control.

Referring to FIGS. 14B and 14C, a further embodiment will be described wherein the temperature is controlled by controlling a number of waves of the AC voltage energization. FIGS. 14B and 14C are output waveforms when the phase control and a wave number control are effected such that the input AC voltage and the effective voltage applied to the load are one-halved. In the phase control, the load L is energized from the control phase angle $\alpha$ to the angle $\pi$ to control the energy. In the wave number control, the number of waves having the basic period $\tau 1$ is changed during the energization period $\tau 2$ (unit period). Here, the period $\tau 2$ is always $\tau 1$ multiplied by an integer and divided by 2. Alternatively, the basic voltage waveform may have the period of $\tau 1/2$.

The embodiment for the energy control described above will be explained. The block diagram is equivalent to that shown in FIG. 6. Similarly to the embodiment of FIG. 7A, the control circuit 42 effects wave number control to control the energy applied to the heat generating layer in connection with the temperature of the heat generating layer. The operation of the control circuit 42 will be described.

In the example taken, the control circuit includes a microprocessor. The structure of the control circuit is the same as shown in FIG. 13. In FIG. 13, reference Q44 is a phototriac in the triggering circuit; Q43 designates a driver for the phototriac Q44; $R_{TH}$ designates a thermistor. The heater temperature appears as a divided voltage Vc by the resistor R47 and the thermistor $R_{TH}$. The microcomputer Q45 reads the output of the thermistor $R_{TH}$ at the analog input port Ad, and in synchronism with the signal of the zero-cross detecting circuit, it produces a signal to the driver Q43.

Figure 15:
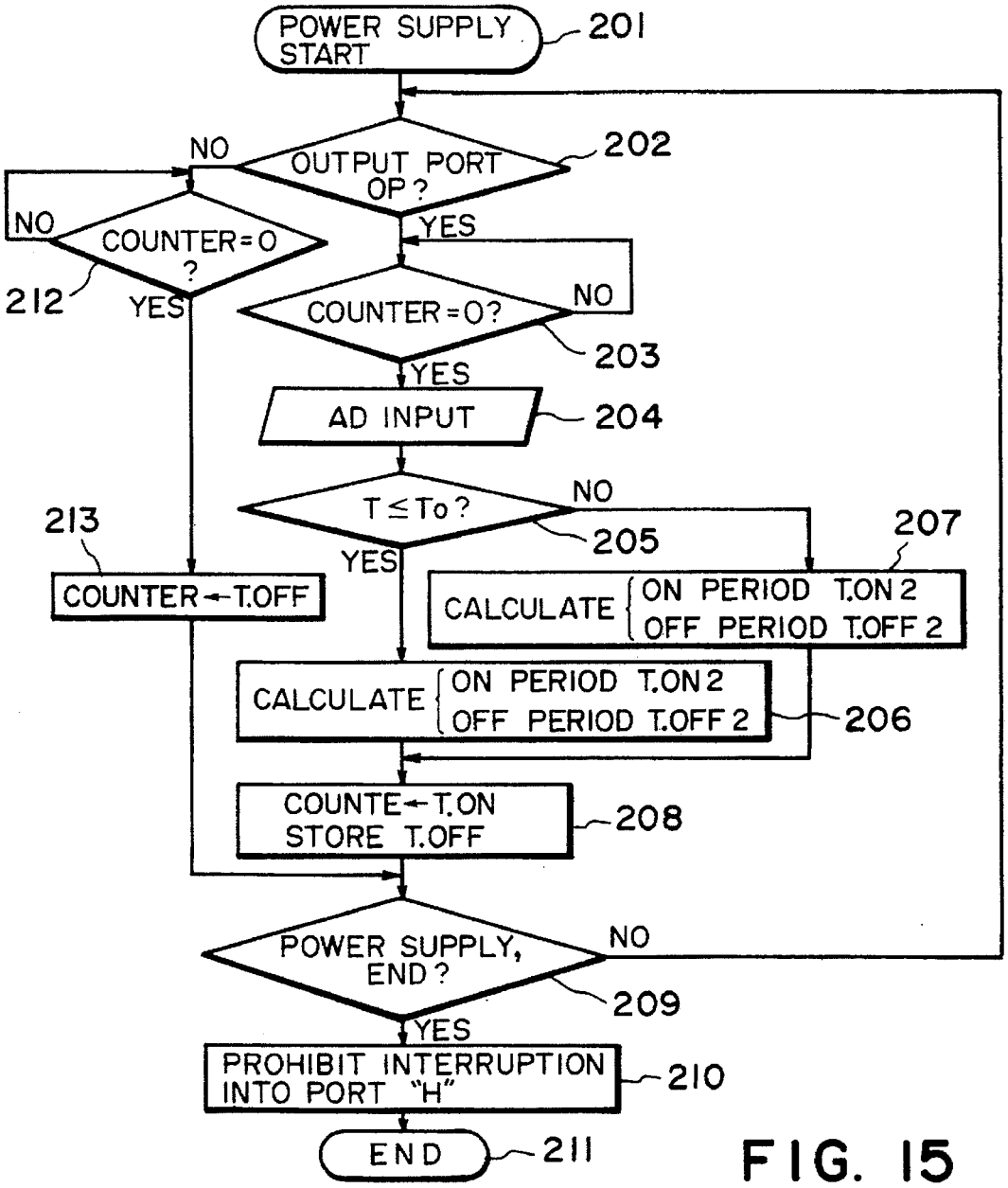
FIGS. 15 and 16 are flow charts illustrating the wave number control.
Figure 16:
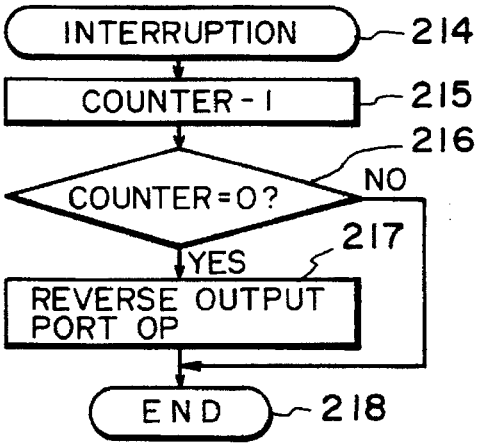

FIGS. 15 and 16 show a control algorithm. FIG. 16 is an interruption routine for making interruption at the zero-cross points of the AC source voltage.

In the interruption routine, a counter COUNTER is decremented by one (215), and when it becomes zero (216), the level of the output port OP is reversed. In the main routine (FIG. 15), the counter COUNTER is set each time the count of the counter COUNTER becomes zero (208, 213). The count of the counter COUNTER represents a datum TON corresponding to the period in which the TRIAC BCR1 is on, and a datum TOFF corresponding to the period in which it is off. The datum TON and TOFF are associated. In FIG. 15, the state of the output port OP is discriminated (202), and the count of the counter COUNTER is processed only when the count becomes zero (203) from the state of the output port OP being "H" (the TRIAC BCR1 is off). Then, the value of TON is inputted into the counter. When the count of the counter COUNTER becomes zero (212) from the state wherein the output OP is "L" state, the value of TOFF associated with the data TON is inputted into the counter (213). In the processing of the counter COUNTER, the output of the thermistor supplied to the analog input port AD is considered (204). More particularly when the heater temperature T is lower than the temperature T0 (205) the counts TON1 and TOFF1 providing the heating energy W1 is given to the counter, whereas when it is higher, the counts TON2 and TOFF2 providing the energy W2 are given (207). By repeating the above operation, the temperature of the heat generating layer is maintained constant.

As described in the foregoing, according to this embodiment, even if an AC voltage is applied to the heat generating layer having a very small thermal capacity, a constant temperature can be provided.

These and other objects, features and advantages of the present invention will become more apparent upon a consideration of the following description of the preferred embodiments of the present invention taken in conjunction with the accompanying drawings.

What is claimed is:

1. An image fixing apparatus, comprising:

a heater for generating heat upon electric power supply thereto;

a film movable with an unfixed image on a recording material while being in contact with said heater;

a temperature detecting element for detecting the temperature of said heater;

power supply means for supplying electrical power to said heater; and control means for controlling the electrical power supplied to said heater from said power supply means so that a temperature detected by said temperature detecting element is maintained substantially at a predetermined fixing temperature, wherein said control means has at least one power level for raising the temperature of said heater and a plurality of power levels for decreasing the temperature of said heater, and selects the power level in accordance with an output of said temperature detecting element after the temperature of said heater initially reaches the fixing temperature.

2. Art apparatus according to claim 1, wherein said control means controls the electrical power in accordance with an output of said temperature detecting element.

3. An apparatus according to claim 2, wherein temperature detecting element detects a high temperature.

4. An apparatus according to claim 1, wherein said heater is fixedly mounted on a frame of said apparatus, and wherein said film slides on said heater.

5. An apparatus according to claim 1, wherein said heater includes a heat generating resistor for generating heat upon electric power supply thereto, and wherein said heat generating resistor is opposed to said film and extends in a direction crossing with a movement direction of the recording material.

6. An apparatus according to claim 5, further comprising a biasing member for biasing the recording material against said film and toward said heater, so that the heat generated by said heat generating resistor is not transferred to the image on the recording material through an air layer.

7. An apparatus according to claim 1, wherein when said temperature detecting elements detects a temperature lower than said fixing temperature during operation of said control means, the electrical power controlled by said control means is larger than the heat radiation of said heater.

* * * * *

UNITED STATES PATENT AND TRADEMARK OFFICE

CERTIFICATE OF CORRECTION

PATENT NO. : 5,627,634
DATED : May 6, 1997
INVENTOR(S) : Shokyo KOH

It is certified that error appears in the above-indentified patent and that said Letters Patent is hereby corrected as shown below:

Column 1, line 15, delete "an" and insert therefor --and--; and delete "the" and insert therefor --an--;
Line 37, delete "pulsewisely" and insert therefor --pulsewise--.

Column 3, line 12, delete "3" and insert therefor --4--.

Column 4, line 7, delete "24" and insert therefor --23--.

Column 5, line 7, delete "resister" and insert therefor --resistor--;
Line 35, delete "shows" and insert therefor --show--.

Column 8, line 10, delete "Art" and insert therefor --An--;
Line 13, after "wherein", insert --said control means reduces the electrical power when said--;
Line 30, delete "elements" and insert therefor --element--.

Signed and Sealed this

Twenty-eighth Day of October, 1997

*Attest:*

Bruce Lehman

BRUCE LEHMAN

*Attesting Officer*

*Commissioner of Patents and Trademarks*